US006997405B2

(12) United States Patent
Haruch

(10) Patent No.: US 6,997,405 B2
(45) Date of Patent: Feb. 14, 2006

(54) EXTERNAL MIX AIR ATOMIZING SPRAY NOZZLE ASSEMBLY

(75) Inventor: James Haruch, Naperville, IL (US)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 10/252,194

(22) Filed: Sep. 23, 2002

(65) Prior Publication Data

US 2004/0056124 A1 Mar. 25, 2004

(51) Int. Cl.
*B05B 5/00* (2006.01)
*B05B 1/28* (2006.01)
*A62C 5/02* (2006.01)

(52) U.S. Cl. ..... 239/690; 239/290; 239/291; 239/292; 239/294; 239/8

(58) Field of Classification Search ..... 239/290, 239/291, 292, 294, 295, 296, 297, 298, 299, 239/8
See application file for complete search history.

(56) References Cited

U.S. PATENT DOCUMENTS 4,236,674 A * 12/1980 Dixon ..... 239/296
4,433,812 A * 2/1984 Grime ..... 239/290
4,645,127 A 2/1987 Emory et al.
5,072,883 A 12/1991 Vidusek
5,344,078 A * 9/1994 Fritz et al. ..... 239/296
5,526,981 A * 6/1996 Sanson ..... 239/8
5,829,682 A 11/1998 Haruch
5,899,387 A 5/1999 Haruch
5,964,405 A * 10/1999 Benary et al. ..... 239/84
6,085,996 A 7/2000 Culbertson et al.
6,161,778 A 12/2000 Haruch
6,267,301 B1 7/2001 Haruch
6,378,783 B1 * 4/2002 Ballu ..... 239/290
6,425,533 B1 * 7/2002 Shilton et al. ..... 239/290

* cited by examiner

*Primary Examiner*—Davis Hwu
(74) *Attorney, Agent, or Firm*—Leydig Voit & Mayer, Ltd.

(57) ABSTRACT

An external mix air assisted spray nozzle assembly having a nozzle body, and an air cap for a directing pressurized air streams on a discharging liquid stream external to the liquid discharge orifice of the nozzle assembly for atomizing and forming the liquid into the desired spray pattern. The air cap includes an upstream internal air chamber, an external, downstream liquid discharge and mixing chamber, and a central opening coaxial with the liquid discharge orifice communicating between the upstream and downstream chambers. The air cap further includes a plurality of angled pressurized air discharge passages which communicate with an annular plenum of the air chamber disposed in surrounding relation to the central opening for enabling substantially uniform particle breakdown and distribution at lower air pressures than heretofore possible.

17 Claims, 3 Drawing Sheets

EXTERNAL MIX AIR ATOMIZING SPRAY NOZZLE ASSEMBLY

The present invention relates generally to spray nozzle assemblies, and more particularly, to "external mix" air atomizing spray nozzle assemblies in which a discharging liquid flow stream is atomized and formed into the desired spray pattern by pressurized air externally of the liquid discharge orifice.

BACKGROUND OF THE INVENTION

External mix air atomizing spray nozzles are known for their ability to control of liquid particle size and spray distribution by pressurized air, independent of the liquid flow rate. They also can be used with relatively low pressure air supplies, such as on the order of 15 psi, which can be generated from inexpensive blowers, rather than air compressors. However, such spray nozzles typically must be formed with intricate air flow passages which communicate through the spray nozzle to locations downstream of the liquid discharge orifice. Such passageways are expensive to manufacture, create pressure losses, and if not formed with precision and accuracy can result in burrs and passage misalignments that cause further pressure losses that detract from efficient operation of the spray nozzle. Hence, the pressurized air supply generated by low-pressure blowers sometimes is inadequate to enable effective liquid particle breakdown and direction. Moreover, while external mix air atomizing spray nozzles have been used for producing flat fan spray patterns, heretofore they have not been effective, at low pressures, for generating full cone liquid spray patterns with substantially uniform liquid particle breakdown.

OBJECTS AND SUMMARY OF THE INVENTION

It is an object of the present invention to provide an external mix air atomizing spray nozzle assembly which is adapted for more efficient and reliable operation.

Another object is to provide an external mix air atomizing spray nozzle assembly as characterized above which can be effectively operated at substantially lower air pressures than heretofore possible.

A further object is to provide an external mix spray nozzle assembly of the above kind which can be effectively operated at relatively low air pressures in producing flat or full cone liquid spray patterns with substantially uniform liquid particle breakdown.

Still another object is to provide such an external mix air atomizing spray nozzle assembly that has an air-directing cap which is adapted for more economical manufacture. A related object is to provide a reliable method of making such air cap.

Other objects and advantages of the invention will become apparent upon reading the following detailed description and upon reference to the drawings, in which:

Figure 1:
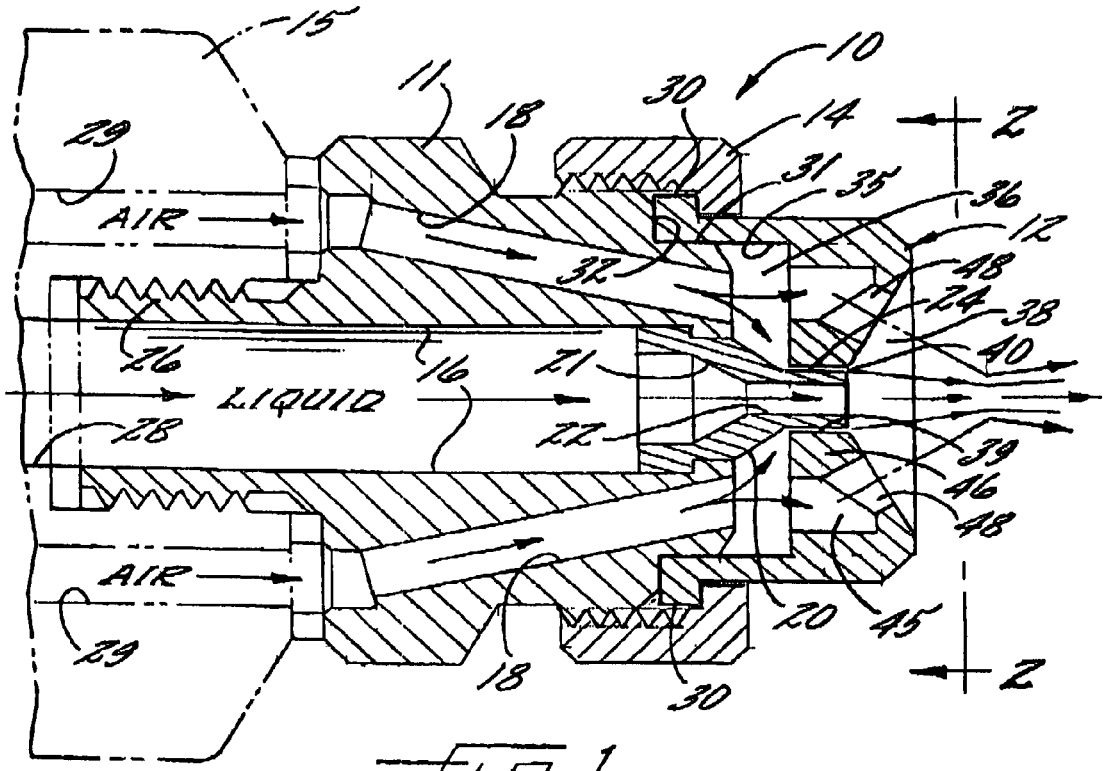
FIG. 1 is a longitudinal section of an illustrative spray nozzle assembly in accordance with the invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

Referring now more particularly to the drawings, there is shown an illustrative spray nozzle assembly 10 embodying the present invention. The spray nozzle assembly 10 in this case comprises a nozzle body 11, an air cap 12 mounted at the downstream into the nozzle body 11, and a retaining ring 14 for releasably securing the air cap 12 in mounting position. The illustrated spray nozzle assembly 10 is mounted on a base portion 15 through which pressurized liquid and air is supplied from appropriate sources.

The illustrated nozzle body 11 is formed with a central liquid passage 16 and a plurality of pressurized air or gas passages 18 disposed in circumferentially spaced relation about the liquid passage 16. The liquid passage 16 in this case communicates with a liquid discharge spray tip 20 fixed in the downstream end of the nozzle body 11 in forwardly extending relation thereto. The liquid spray tip 20 defines a tapered entry chamber 21 which communicates with a smaller diameter liquid discharge passage 22 formed in a relatively small diameter nose 24 of the spray tip 25. The air passages 18 extend in substantially straight fashion between upstream and downstream ends of the nozzle body in inwardly tapered relation to the longitude axis of the nozzle assembly.

The nozzle body 10 is connected to the base portion 15 by a rearwardly extending externally threaded stem 26 of the nozzle body 11 received in a threaded cavity in the base portion 15 such that the liquid and air passages 16, 18 of the nozzle body 11 are aligned with corresponding liquid and air passages 28, 29 in the base portion 15. Liquid and air inlet ports (not shown) which communicate respectively with the liquid and air passages 28, 29 are provided in the base portion 15. In a known manner, suitable supply lines can be attached to the liquid and gas inlet ports to supply the nozzle assembly 10 with pressurized liquid and gas.

The air cap 12 has a cylindrical upstream end portion with an outwardly extending radial flange 30 that is secured to the nozzle body 11 by the retaining ring 14 which is threaded into an externally threaded portion of the nozzle body 11. For ensuring proper seating of the air cap 12 on the nozzle body 11, a downstream end of the nozzle body 11 is formed with a cylindrical hub 31 onto which the air cap 12 is positionable against an annular seat 32 of the nozzle body 11.

In accordance with the invention, the air cap has a simple to manufacture construction which enables more efficient utilization of pressurized air in atomizing and directing the desired liquid spray pattern. To this end, the air cap 12 is formed with an upstream opening counterbore or chamber 35 that is mountable on the nozzle body hub 31 and which together with the end of the nozzle body 11 defines a generally cylindrical air chamber 36 communicating with the nozzle body air passages 18. The downstream end of the air cap 12 is formed with an external discharge and mixing chamber 38, preferably frustoconical in shape and extending in outwardly opening fashion in a downstream direction at an angle Φ of between 30 and 120°, depending on the desired spray pattern. The air cap 12 is further formed with a central cylindrical opening 39 which extends between the cylindrical air chamber 36 and the discharge and mixing chamber 38 and which receives the forwardly extending nose 24 of the liquid spray tip 20. The downstream end of the spray tip nose 24 is located adjacent the downstream end of the cylindrical opening 39 and is concentrically located within the opening 39 such that the outer perimeter of the nose 24 and the cylindrical opening 39 define an annular air passage 40 communicating between the cylindrical air chamber 36 and the liquid discharge and mixing chamber 38. It will be seen that pressurized air communicated from the air inlet passages 29 through the nozzle body air passages 18 and into the cylindrical air chamber 36 of the air cap 12 will communicate through the annular air passage 40 and discharge in surrounding relation to a liquid flow stream discharging from the spray tip 20, preliminarily atomizing and axially directing the liquid flow stream as it proceeds into and through the discharge and mixing chamber 38.

In carrying out the invention, the air cap 12 is formed with an annular air plenum or chamber 45 which defines a central hub 46 intermediate the cylindrical air chamber 36 and the liquid discharge and mixing chamber 38 and which communicates with the liquid discharge and mixing chamber 38 downstream of the liquid discharge passage 22 through a plurality of angled air discharge passages 48 for effecting the desired spray characteristics. The annular air plenum or chamber 45 in this case is defined by an outer cylindrical sidewall 50 which is only slightly smaller in diameter than the counterbore 35, a downstream end wall 51 perpendicular thereto, a cylindrical sidewall 52 of the hub 46, and an outwardly tapered sidewall 54. The angled passages 48 are cylindrically configured and in this case extend in substantially perpendicular relation to the conical surface that defines the external liquid discharge and mixing chamber 38.

It will be understood by one skilled in the art that since the angled air discharge passages 48 communicate with the annular plenum or chamber 45, the angled passages 48 may be readily formed, such as by drilling, without close tolerances or multiple drilling operations and without the necessity for aligning the passages with other small drilled holes or passages. Hence, there is less likelihood for misalignment of the air discharge passages, burrs, or sharp bends in the passages that can create pressure losses and hinder efficient liquid atomization and direction. Indeed, it has been unexpectedly found that a spray nozzle assembly according to the present invention may be operated at substantially lower air atomizing pressures than heretofore possible. In practice, effective spraying has been achieved with air pressures as low as 3 psi, which can be generated by a relatively small, inexpensive blower. Moreover, since the pressurized atomizing and directing air impinges the liquid flow stream at locations downstream, i.e., external, of the liquid spray tip, the pressurized air streams are advantageously effective for atomizing and forming the desired spray pattern independent of the liquid flow rate. Variations in air pressure therefore can be utilized for altering liquid particle size and distribution, without affecting the liquid flow rate. Increasing air pressure will increase atomization, while lower operating air pressure will permit direction of spray patterns with larger particle sizes.

Figure 2:
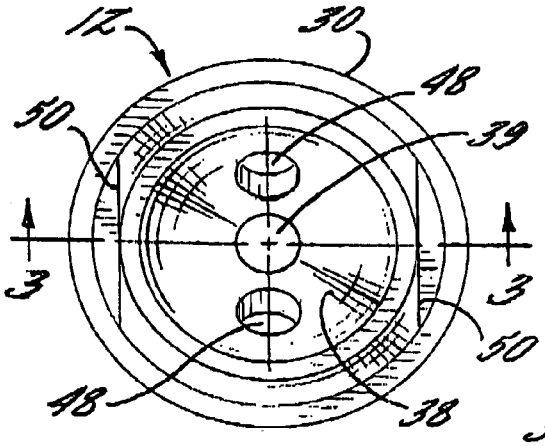
FIG. 2 is an end view of the air cap of the illustrated spray nozzle assembly taken in the plane of line 2—2 in FIG. 1.
Figure 3:
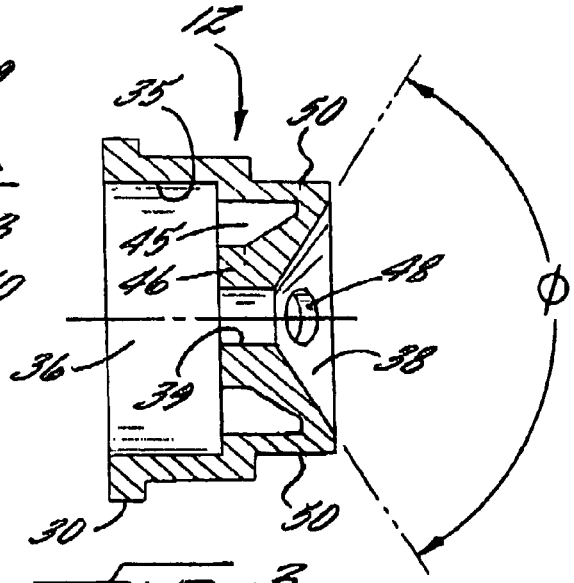
FIG. 3 is a longitudinal section of the air cap taken in the plane of line 3—3 in FIG. 2.

In keeping with the invention, the design of the air cap 12 of the present invention can be readily modified for the desired spray pattern and liquid particle size to be generated by the nozzle assembly. The air cap 12, as depicted in FIGS. 1–3, for example, is designed for generating and directing a flat spray pattern. To this end, the air cap 12 has a pair of angled pressurized air discharge passages 48 located in opposing relation to each other on opposite sides of the liquid discharge orifice 22. Pressurized air emitted from the annular air discharge passage 40 preliminarily atomizes and directs the liquid in a downstream direction as it emits from the liquid spray tip 20, while the pressurized air directed from the angled air discharge orifices 48 further atomizes the discharging liquid while shaping the particles into a substantially flat spray pattern with substantially uniform liquid particle breakdown.

In order to assist the user of the spray nozzle assembly 10 in orienting the air cap 12 for the desired orientation of the discharging flat spray pattern, the downstream end of the air cap 12 is formed with flats 50 on opposed sides of the angled discharge passages 48, which are thereby in perpendicular relation to the orientation of the discharging flat spray pattern. It will be understood by one skilled in the art that the flats 50 may pass through opposite sides of the liquid discharge and mixing chamber 38, thereby opening the opposed sides of the chamber. As used herein, the term liquid discharge and mixing chamber is not limited to a close-sided chamber.

Figure 4:
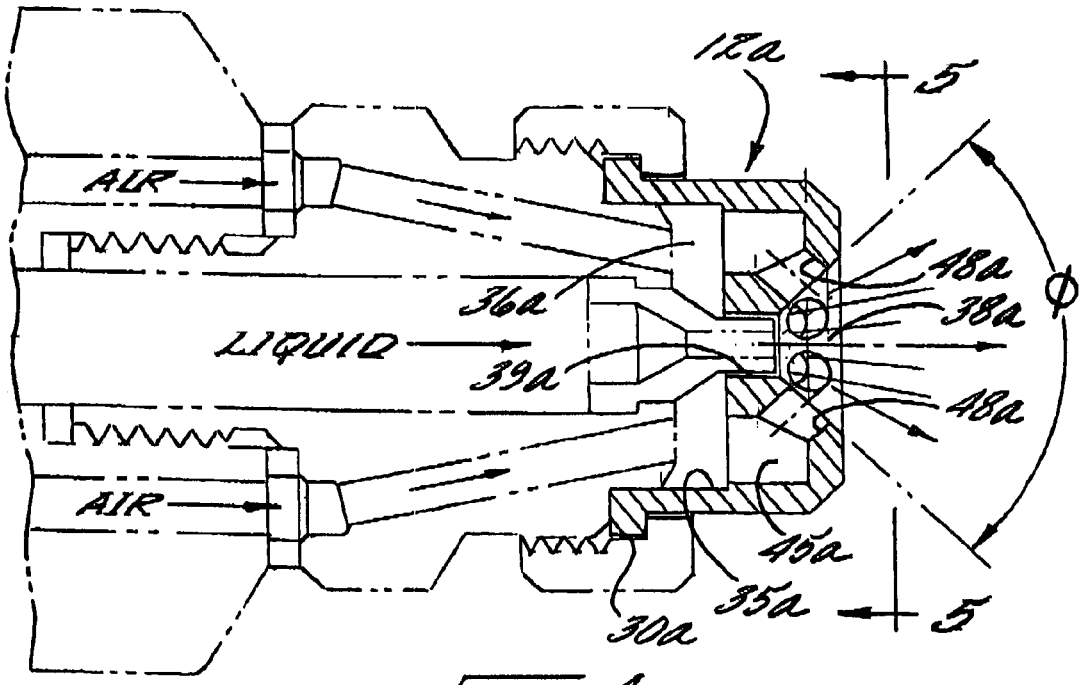
FIG. 4 is a longitudinal section of a spray nozzle assembly having an alternative embodiment of air cap.
Figure 5:
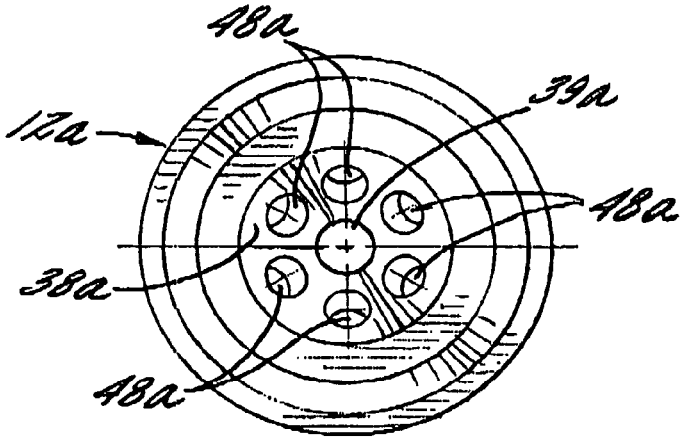
FIG. 5 is an air cap of the spray nozzle assembly of FIG. 4, taken in the plane of line 5—5.

Referring now to FIGS. 4–5, there is shown an alternative form of air cap 12*a* in accordance with the invention for use with the illustrated spray nozzle assembly, wherein items similar to those described above have been given similar reference numerals with the distinguishing suffix "a" added. The air cap 12*a* in this case is adapted to generating and directing a relatively narrow, round full cone spray pattern. The air cap 12*a* again is formed with an upstream internal air chamber 36*a* that includes an annular air plenum 45*a* in surrounding relation to a central air cap opening 39*a* and angled passages 48*a* communicating between the annular chamber 45*a* and the downstream liquid and discharge chamber 38*a*.

In carrying out this embodiment of the invention, the air cap 12*a* is formed with a plurality, in this case six, equally spaced angled pressurized air discharge passages 48*a* at equal circumferentially spaced locations about the central air cap opening 39*a*. The combination of the annular stream of pressurized atomizing air directed axially through the central air cap opening 39*a* and the plurality of circumferentially spaced, angled pressurized air streams discharging from the angled passages 48*a* forms and directs the liquid into a round full cone spray pattern with substantially uniform liquid particle atomization distributed throughout the pattern.

Figure 6:
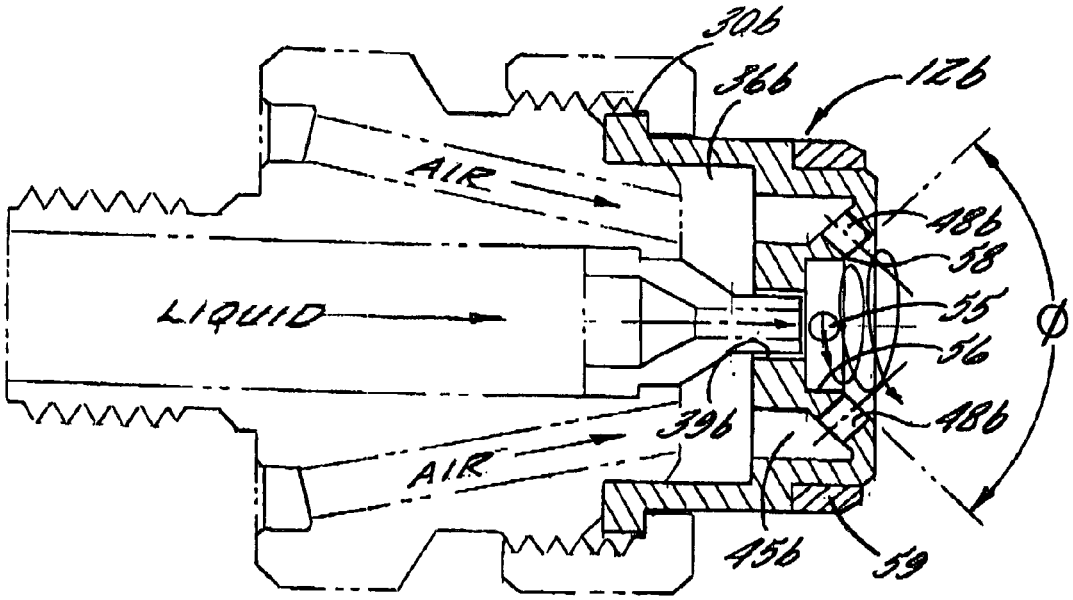
FIG. 6 is a longitudinal section of a spray nozzle assembly having still another alternative embodiment of air cap in accordance with the invention.
Figure 7:
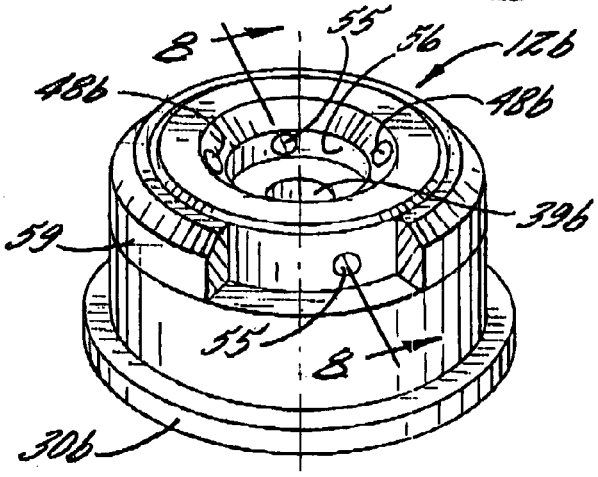
FIG. 7 is a perspective of the air cap of the spray nozzle assembly shown in FIG. 6.
Figure 8:
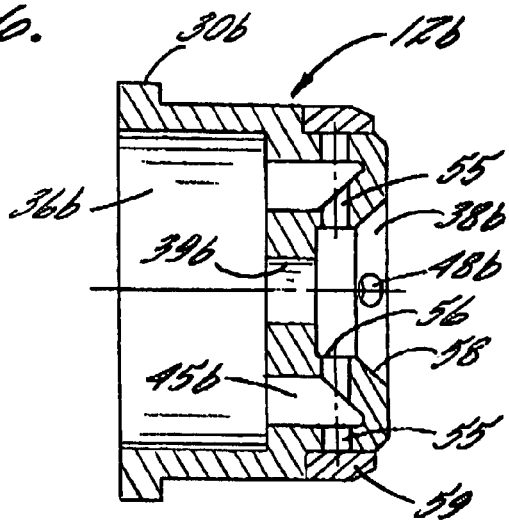
FIG. 8 is a longitudinal section of the air cap shown in FIG. 7, taken in the plane of line 8—8.

Referring now to FIGS. 6–8, there is shown a further alternative embodiment of air cap 12*b* for use with the spray nozzle assembly in accordance with the invention, wherein items similar to those described above have been given similar reference numerals with the distinguishing suffix "b"

added. The air cap 12*b* in this case is adapted for producing a wider angle, round full cone spray pattern with substantially uniform particle distribution throughout the pattern. The air cap 12*b* again is formed with an upstream air chamber 36*b* having an internal annular air plenum 45*b* in surrounding relation to a central air cap opening 39*b* communicating with an upstream air chamber 36*b*. The air cap 12*b*, similar to the embodiment of FIGS. 1–3, has a pair of opposed pressurized air discharge orifices 48*b* communicating between the annular air plenum 45*b* and the liquid discharge and mixing chamber 38*b*.

In carrying out this embodiment of the invention, to facilitate liquid atomization and to create a full cone swirling liquid spray pattern, the air cap 12*b* is formed with a pair of tangential air discharge passages 55 downstream of the central air cap opening 39*b* and upstream of the angled pressurized air discharge passages 48*b*. The liquid discharge and mixing chamber 38*b* in this instance has a cylindrical upstream portion defined by a cylindrical sidewall 56 which communicates with an outwardly opening frustoconical portion defined by a frustoconical sidewall 58. The tangential air passages 55 are in a common plane perpendicular to the longitudinal axis of the air cap 12*b* and tangentially communicate through the cylindrical sidewall 56 from the annular air plenum 45*b*. For ease of manufacturing, the tangential passages 55 are defined by drilled holes that extend completely through the outer sidewall of the annular plenum 45*b*. A ring 59 is then fitted in tightly surrounding relation to the downstream end of the air cap, in this case within a reduced diameter portion thereof, for sealing the outer ends of the tangential passages 55.

It will be understood that pressurized air discharging from the tangential passages 55 atomizes and imparts swirling movement to the discharging liquid, and simultaneously, pressurized air discharged from the angled passages 48*b* impinge upon the swirling liquid downstream thereof for further atomizing the liquid and further shaping the liquid particles into the desired conical spray pattern. The unique combination of the tangential and angled pressurized air passages 55, 48*b* have been unexpectedly found to produce relatively wide angle, round full-cone spray patterns with substantially uniform liquid particle breakdown.

Figure 9:
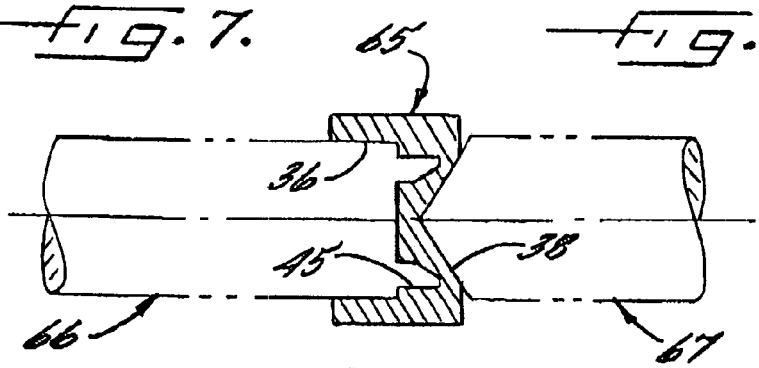
FIG. 9 is a diagrammatic depiction illustrating a method of manufacturing an air cap in accordance with the invention.

In keeping with the invention, it will be appreciated by one skilled in the art that the air cap 12, 12*a*, 12*b* lends itself to economical and efficient manufacture. Indeed, the air cap may be machined without tight tolerances. From a cylindrical blank 65, as depicted in FIG. 9, the cylindrical chamber 36 and annular air plenum 45 may be machined in a forming operation. It will be understood that the cylindrical air chamber 36 and annular air plenum 45 may be formed with a single forming tool 66 in a single machining operation, or alternatively, may be formed in a two-step machining operation with separate forming tools. The outwardly opening liquid discharge and mixing chamber 38 may similarly be machined by a forming tool 67.

In carrying out an important aspect of the method invention, the central air cap opening 39, the angled pressurized air passages 48, and the tangential air passages 55 may be formed by drilling, without the necessity for aligning the drilled holes with other drilled or small diameter apertures. Like the central air cap opening 39, the angled pressurized air passages 48 and the tangential air passages 45 communicate between open chambers or plenums so as to eliminate the necessity for accurate alignment with other drilled holes or apertures, which reduces the potential for sharp edges or burrs in the passages that can impede air flow, create pressure drops, and hinder spraying efficiency. The remaining external features for the air cap, such as the flats 50 and retaining flange 30, also may be readily machined in a conventional manner.

From the foregoing, it can be seen that the external mix air atomizing spray nozzle assembly of the present invention is adapted for both economical manufacture and more efficient and reliable operation. The spray nozzle assembly can be operated at substantially lower air pressures than heretofore possible, and by easy design modification, can be effectively used for directing flat or full cone liquid spray patterns with substantially uniform liquid particle breakdown.

What is claimed:

1. An air assisted spray nozzle assembly comprising:

a nozzle body having a liquid passage for connection to a pressurized liquid supply and an air passage for connection to a pressurized air supply, said liquid passage having a downstream liquid discharge orifice from which a pressurized liquid stream is axially discharged, an air cap disposed adjacent said nozzle body, said air cap being formed with an air chamber communicating with said air passage, said air cap being formed with an external liquid discharge and mixing chamber in a downstream end thereof and a central opening coaxial with said liquid discharge orifice communicating between said air chamber and said liquid discharge and mixing chamber, said air chamber including an annular plenum disposed in radially spaced surrounding relation to said central opening, and said air cap having a plurality of straight pressurized air discharge passages extending without bend between said annular plenum and said liquid discharge and mixing chamber at an angle to the axis of said central air cap opening and liquid discharge orifice for directing pressurized air onto a liquid flow stream discharging from said liquid discharge orifice at a location downstream of said liquid discharge orifice for further atomizing the liquid and directing discharging liquid into a predetermined spray pattern.

2. The spray nozzle assembly of claim 1 in which said liquid passage discharge orifice is defined by a liquid spray tip fixed in said nozzle body, and said liquid spray tip having a nose concentrically located in said central air cap opening for defining an annular air discharge passage communicating between said air chamber and said liquid discharge and mixing chamber through which pressurized air is axially directed in surrounding relation to a liquid flow stream discharging from said liquid discharge orifice.

3. The spray nozzle assembly of claim 1 in which said air chamber includes a cylindrical chamber in an upstream end of said air cap which communicates with said annular plenum.

4. The spray nozzle assembly of claim 1 in which said liquid discharge orifice is disposed adjacent a downstream end of said central air cap opening.

5. The spray nozzle assembly of claim 1 in which said central air cap opening is defined by and extends through a hub of said air cap disposed intermediate upstream and downstream ends of said air cap, and said annular plenum is disposed in surrounding relation to said hub.

6. The spray nozzle assembly of claim 1 in which said angled air discharge passages are straight cylindrical bores that extend between said annular plenum and said liquid discharge and mixing chamber.

7. An air assisted spray nozzle assembly comprising:

a nozzle body having a liquid passage for connection to a pressurized liquid supply and an air passage for connection to a pressurized air supply, said liquid passage having a downstream liquid discharge orifice from which a pressurized liquid stream is axially discharged, an air cap disposed adjacent said nozzle body, said air cap being formed with an internal air chamber communicating with said air passage, said air cap being formed with an external liquid discharge and mixing chamber in a downstream end thereof, said air cap having a hub intermediate upstream and downstream ends of said air cap, said hub being formed with a central opening coaxial with said liquid discharge orifice communicating between said air chamber and said liquid discharge and mixing chamber, said air chamber including an annular plenum disposed in radially spaced surrounding relation to said hub, and said air cap having a plurality of straight pressurized air discharge passages extending without bend between said annular plenum and said liquid discharge and mixing chamber at an angle to the axis of said central air cap opening and liquid discharge orifice for directing pressurized air onto a liquid flow stream discharging from said liquid discharge orifice at a location downstream of said liquid discharge orifice for further atomizing the liquid and directing discharging liquid into a predetermined spray pattern.

8. The spray nozzle assembly of claim 7 in which said liquid passage discharge orifice is defined by a liquid spray tip fixed in said nozzle body, and said liquid spray tip and said central air cap opening defining an annular air discharge passage communicating between said air chamber and said liquid discharge and mixing chamber through which pressurized air is axially directed in surrounding relation to a liquid flow stream discharging from said liquid discharge orifice.

9. The spray nozzle assembly of claim 7 in which said annular plenum extends in a downstream direction beyond a downstream end of said central air cap opening.

10. The spray nozzle assembly of claim 7 in which said angled air discharge passages are straight cylindrical bores that extend between said annular plenum and said liquid discharge and mixing chamber.

11. The spray nozzle assembly of claim 9 in which said liquid discharge and mixing chamber has an outwardly expanding frustoconical shape, and said angled air discharge passages communicate in perpendicular relation through frustoconical wall surfaces of said liquid discharge and mixing chamber.

12. The spray nozzle assembly of claim 11 in which said liquid discharge orifice is disposed adjacent a downstream end of said central air cap opening.

13. An air assisted spray nozzle assembly comprising:

a nozzle body having a liquid passage for connection to a pressurized liquid supply and an air passage for connection to a pressurized air supply, said liquid passage having a downstream liquid discharge orifice from which a pressurized liquid stream is axially discharged, an air cap disposed adjacent said nozzle body, said air cap being formed with an air chamber communicating with said air passage, said air cap being formed with an external liquid discharge and mixing chamber in a downstream end thereof and a central opening coaxial with said liquid discharge orifice communicating between said air chamber and said liquid discharge and mixing chamber, said air chamber including an annular plenum disposed in radially aligned, spaced surrounding relation to said central air cap opening, said annular plenum extending in a downstream direction beyond a downstream end of said central air cap opening, and said air cap having a plurality of angled pressurized air discharge passages communicating between said annular plenum and said liquid discharge and mixing chamber at an angle to the axis of said central air cap opening and liquid discharge orifice for directing pressurized air onto a liquid flow stream discharging from said liquid discharge orifice at a location downstream of said liquid discharge orifice for further atomizing the liquid and directing discharging liquid into a predetermined spray pattern.

14. An air assisted spray nozzle assembly comprising:

a nozzle body having a liquid passage for connection to a pressurized liquid supply and an air passage for connection to a pressurized air supply, said liquid passage having a downstream liquid discharge orifice from which a pressurized liquid stream is axially discharged, an air cap disposed adjacent said nozzle body, said air cap being formed with an air chamber communicating with said air passage, said air cap being formed with an external liquid discharge and mixing chamber in a downstream end thereof having an outwardly expanding frustoconical shape and a central opening coaxial with said liquid discharge orifice communicating between said air chamber and said liquid discharge and mixing chamber, said air chamber including an annular plenum disposed in radially spaced surrounding relation to said central opening, and said air cap having a plurality of angled pressurized air discharge passages communicating between said annular plenum and said liquid discharge and mixing chamber at an angle to the axis of said central air cap opening and liquid discharge orifice and in perpendicular relation through frustoconical wall surfaces of said liquid discharge and mixing chamber for directing pressurized air onto a liquid flow stream discharging from said liquid discharge orifice at a location downstream of said liquid discharge orifice for further atomizing the liquid and directing discharging liquid into a predetermined spray pattern.

15. The spray nozzle assembly of claim 14 in which said air cap includes a pair of opposed angled air discharge passages for directing the discharging liquid into a flat spray pattern.

16. The spray nozzle assembly of claim 15 in which said air cap is formed with a pair of externally exposed flats oriented in perpendicular relation to a flat spray pattern discharging from said air cap for providing an indication of the orientation of the discharging flat spray pattern.

17. An air assisted spray nozzle assembly comprising:

a nozzle body having a liquid passage for connection to a pressurized liquid supply and an air passage for connection to a pressurized air supply, said liquid passage having a downstream liquid discharge orifice from which a pressurized liquid stream is axially discharged, an air cap disposed adjacent said nozzle body, said air cap being formed with an air chamber communicating with said air passage, said air cap being formed with an external liquid discharge and mixing chamber in a downstream end thereof and a central opening coaxial with said liquid discharge orifice communicating between said air chamber and said liquid discharge and mixing chamber, said air chamber including an annular plenum disposed in radially aligned and spaced surrounding relation to said central opening, and said air cap having a plurality of pressurized air discharge passages in the form of straight bores extending without bend between said annular plenum and said liquid discharge and mixing chamber at an angle to the axis of said central air cap opening and liquid discharge orifice for directing pressurized air onto a liquid flow stream discharging from said liquid discharge orifice at a location downstream of said liquid discharge orifice for further atomizing the liquid and directing discharging liquid into a predetermined spray pattern.

* * * * *